US007470354B2

(12) United States Patent
Lorentsen et al.

(10) Patent No.: US 7,470,354 B2
(45) Date of Patent: Dec. 30, 2008

(54) UTILISATION OF OXYGEN EVOLVING ANODE FOR HALL-HÈROULT CELLS AND DESIGN THEREOF

(75) Inventors: Odd-Arne Lorentsen, Porsgrunn (NO); Ole-Jacob Siljan, Skien (NO); Stein Julsrud, Skien (NO)

(73) Assignee: Norsk Hydro ASA, Oslo (NO)

( * ) Notice: Subject to any disclaimer, the term of this patent is extended or adjusted under 35 U.S.C. 154(b) by 256 days.

(21) Appl. No.: 10/525,242

(22) PCT Filed: Aug. 15, 2003

(86) PCT No.: PCT/NO03/00279

§ 371 (c)(1),
(2), (4) Date: Aug. 5, 2005

(87) PCT Pub. No.: WO2004/018736

PCT Pub. Date: Mar. 4, 2004

(65) Prior Publication Data

US 2006/0102490 A1 May 18, 2006

(30) Foreign Application Priority Data

Aug. 23, 2002 (NO) ..... 20024048

(51) Int. Cl.
*C25C 3/12* (2006.01)

(52) U.S. Cl. ..... 205/381; 205/391; 205/375; 205/385; 205/387; 204/243.1; 204/247.3

(58) Field of Classification Search ..... 204/243.1, 204/247.3; 205/375, 385, 387, 391, 381
See application file for complete search history.

(56) References Cited

U.S. PATENT DOCUMENTS 4,504,366 A 3/1985 Jarrett et al.

(Continued)

FOREIGN PATENT DOCUMENTS

WO 01/63012 8/2001

OTHER PUBLICATIONS

Metallurgical and Materials Transactions B, vol. 27B, Feb. 1996, R. Shekhar et al., "*Physical Modeling Studies of Electrolyte Flow Due to Gas Evolution and Some Aspects of Bubble Behavior in Advanced Hall Cells: Part III. Predicting the Performance of Advanced Hall Cells*", pp. 19-27.

(Continued)

*Primary Examiner*—Bruce F Bell
(74) *Attorney, Agent, or Firm*—Wenderoth, Lind & Ponack, L.L.P.

(57) ABSTRACT

A method for electrolytic production of aluminium metal from an electrolytic (3) including aluminium oxide, by performing electrolysis, with at least one inert anode (1) and at least one cathode (2) thus forming part of an electorwinning cell. The anode evolves oxygen gas and the cathode has aluminium discharged onto it in the electrolysis process, where the oxygen gas enforces an electrolyte flow pattern. The oxygen gas is directed to flow into anode grooves and is drained away from the interpolar room, thereby establishing an electrolyte flow pattern between the electrodes (1) and (2) and between over the anodes (1). The invention also concerns and anode assembly and an electrowinning cell.

29 Claims, 3 Drawing Sheets

U.S. PATENT DOCUMENTS

| | | | | |
|---|---|---|---|---|
| 6,093,304 | A * | 7/2000 | de Nora | 205/381 |
| 6,447,667 | B1 * | 9/2002 | Bates et al. | 205/384 |
| 6,540,887 | B2 * | 4/2003 | de Nora | 204/243.1 |
| 6,656,340 | B2 * | 12/2003 | de Nora et al. | 205/389 |
| 2003/0010628 | A1 * | 1/2003 | De Nora et al. | 204/243.1 |
| 2004/0163967 | A1 * | 8/2004 | LaCamera et al. | 205/381 |
| 2004/0178079 | A1 * | 9/2004 | Julsrud et al. | 205/380 |

OTHER PUBLICATIONS

Metallurgical and Materials Transactions B, vol. 25B, Jun. 1994, R. Shekhar et al., "*Physical Modeling Studies of Electrolyte Flow Due to Gas Evolution and Some Aspects of Bubble Behavior in Advanced Hall Cells: Part II. Flow and Interpolar Resistance in Cells with a Grooved Anode*", pp. 341-349.

* cited by examiner

UTILISATION OF OXYGEN EVOLVING ANODE FOR HALL-HÈROULT CELLS AND DESIGN THEREOF

The present invention relates to a method for production of aluminium by the use of at least one inert anode and the corresponding design of the anode and cell.

BACKGROUND ART

Aluminium is presently produced by electrolysis of an aluminium-containing compound dissolved in a molten electrolyte, and the electrowinning process is performed in cells of conventional Hall-Hèroult design. These electrolysis cells are equipped with horizontally aligned electrodes, where the electrically conductive anodes and cathodes of today's cells are made from carbon materials. The electrolyte is based on a mixture of sodium fluoride and aluminium fluoride, with smaller additions of alkaline and alkaline earth fluorides. The electrowinning process takes place as the current passed through the electrolyte from the anode to the cathode causes the electrical discharge of aluminium-containing ions at the cathode, producing molten aluminium, and the formation of carbon dioxide at the anode (see Haupin and Kvande, 2000). The overall reaction of the process can be illustrated by the equation:

$$2Al_2O_3+3C=4Al+3CO_2 \quad (1)$$

Due to the horizontal electrode configuration, the preferred electrolyte composition and the use of consumable carbon anodes, the currently used Hall-Hèroult process displays several shortcomings and weaknesses. These weaknesses include area-intensive design, high investment costs, troublesome electrolyte and metal flow patterns, expensive electric busbar systems, etc.

The traditional aluminium production cells utilise carbon materials as the electrically conductive cathode. Since carbon is not wetted by molten aluminium, it is necessary to maintain a deep pool of molten aluminium metal above the carbon cathode, and it is in fact the surface of the aluminium pool that is the "true" cathode in the present cells. A major drawback of this metal pool is that the high amperage of modern cells (>150 kA) creates considerable magnetic forces, disturbing. As a result, the metal tends to move around in the cell causing wave movements that might locally shortcut the cell and promote dissolution of the produced aluminium into the electrolyte. In order to overcome this problem, complex busbar systems are designed to compensate for the magnetic forces and to keep the metal pool as stable and flat as possible. The complex busbar system is costly, and if the disturbance of the metal pool is too large, aluminium dissolution in the electrolyte will be enhanced, resulting in reduced current efficiency due to the back reaction:

$$2Al+3CO_2=Al_2O_3+3CO \quad (2)$$

The preferred carbon anodes of today's cells are consumed in the process according to reaction (1), with a typical gross anode consumption of 500 to 550 kg of carbon per tonne of aluminium produced. The use of carbon anodes results in the production of pollutant greenhouse gases like $CO_2$ and CO in addition to the so-called PFC gases ($CF_4$, $C_2F_6$, etc.) which are even more pollutant greenhouse gases and very stable. The consumption of the anode in the process means that the interpolar distance in the cell will constantly change, and the position of the anodes must be frequently adjusted to keep the optimum operating interpolar distance. Additionally, each anode is replaced with a new anode at regular intervals. Even though the carbon material and the manufacture of the anodes are relatively inexpensive, the handling of the used anodes (butts) makes up a major portion of the operating cost in a modern primary aluminium smelter.

The raw material used in the Hall-Hèroult cells is aluminium oxide, also called alumina. Alumina has a relatively low solubility in most electrolytes. In order to achieve sufficient alumina solubility, the temperature of the molten electrolyte in the electrowinning cell must be kept high. Today, normal operating temperatures for Hall-Hèroult cells are in the range 940-970° C. To maintain the high operating temperatures, a considerable amount of heat must be generated in the cell, and the major portion of the heat generation takes place in the interpolar space between the electrodes. Due to the high electrolyte temperature, the side walls of today's aluminium production cells are not resistant to the combination of oxidising gases and cryolite-based melts, so the cell side linings must be protected during cell operation. This is normally achieved by the formation of a crust of frozen bath ledge on the side walls. The maintenance of this ledge necessitates operating conditions where high heat losses through the side walls is a cardinal requirement. This results in the electrolytic production having an energy consumption that is substantially higher than the theoretical minimum for aluminium production. The high resistance of the bath in the interpolar space accounts for 35-45% of the voltage losses in the cell. The state-of-the-art of present technology is cells operating at current load sin the range 250-350 kA, with energy consumption around 13 kWh/kg Al and a current efficiency of 94-95%.

As pointed out, there are several good reasons for improving the cell design and the electrode materials in aluminium electrolysis cells, and several attempts have been made to obtain these improvements.

With an inert anode in the electrowinning of aluminium, the overall reaction would be:

$$2Al_2O_3=2Al+3O_2 \quad (3)$$

Many attempts have been made to find the optimum inert anode material and the Introduction of these materials in electrolytic cells, and numerous patents have been proposed for inert anode materials for aluminium electrowinning. Most of the proposed inert anode materials have been based on tin oxide and nickel ferrites, where the anodes may be a pure oxide material or a cermet type material. The first work on inert anodes was initiated by C. M. Hall, who worked with copper metal (Cu) as a possible anode material in his electrolysis cells. Generally, the inert anodes can be divided into metal anodes, oxide-based ceramic anodes and cermets based on a combination of metals and oxide ceramics. The proposed oxide-containing inert anodes may be based on one or more metal oxides, wherein the oxides may have different functions, as for instance chemical "inertness" towards cryolite-based melts and high electrical conductivity. The proposed differential behaviour of the oxides in the harsh environment of the electrolysis cell is, however, questionable. The metal phase in the cermet anodes may likewise be a single metal or a combination of several metals (metal alloys). The main problem with all of the suggested anode materials is their chemical resistance to the highly corrosive environment due to the evolution of pure oxygen gas (1 bar) and the cryolite-based electrolyte. To reduce the problems of anode dissolution into the electrolyte, additions of anode material components (U.S. Pat. No. 4,504,369) and a self generating/repairing mixture of cerium based oxyfluoride compounds (U.S. Pat. Nos. 4,614,569, 4,680,049 and 4,683,037) have been suggested as possible inhibitors of the electrochemical corrosion of the inert anodes. However, none of these systems have been demonstrated as viable solutions.

The introduction of inert anodes and wettable cathodes in the present Hall-Hèroult electrowinning cells would have a significant impact on reducing the production of greenhouse gases like $CO_2$, CO and PFC's from aluminium production. Also, potentially the reduction in energy added can be substantial if the inter-electrode space can be reduced in comparison to traditional Hall-Hèroult cells.

Patents regarding retrofit or enhanced development of Hall-Hèroult cells are amongst others described in U.S. Pat. Nos. 4,504,366, 4,596,637, 4,614,569, 4,737,247, 5,019,225, 5,279,715, 5,286,359 and 5,415,742, as well as GB 2 076 021. All of these patents address the problems encountered due to the high heat losses in the present Hall-Hèroult cells, and the electrolysis process is operated at reduced interpolar distances. Some of the proposed designs are in addition effective with respect to reducing the surface area of the liquid aluminium metal pad exposed to the electrolyte. However, only a few of the suggested designs have addressed the low production to area ratio of the Hall-Hèroult cells. Amongst others, U.S. Pat. Nos. 4,504,366, 5,279,715 and 5,415,742 have tried to solve this problem by implementation of vertical electrode configurations to increase the total electrode area of the cell. These three patents have also suggested the use of bipolar electrodes. The major problem of the cell design suggested in these patents, however, is that the requirement for a large aluminium pool on the cell bottom to provide electrical contact for the cathodes. This will render the cell susceptible to the influence of the magnetic fields created by the busbar system, and may hence cause local short-circuiting of the electrodes.

Additionally, the referred patents, as well as U.S. Pat. No. 6,030,518, all point to the lowering of the bath temperature as compared to normal Hall-Hèroult cell temperatures as a means of a feasible reduction of the anode corrosion rates in the cell. The utilisation of the gas-lift effect and design of so-called up-corner and down-corner flow funnels are also described in U.S. Pat. No. 4,308,116, specially aimed at magnesium production.

U.S. Pat. No. 4,681,671 describes a novel cell design with a horizontal cathode and several, blade-shaped vertical anodes, and the cell is then operated at low electrolyte temperatures and with an anodic current density at or below a critical threshold value at which oxide-containing anions are discharged preferentially to fluoride anions. By means of forced or natural convection, the melt is circulated to a separate chamber or a separate unit, in which alumina is added before the melt is circulated back into the electrolysis compartment. Although the total surface area of the anode is high in the proposed configuration, the effective anode area is small and limited due to the low electrical conductivity of the anode material relative to the electrolyte. This will substantially limit the useful anodic surface area, and will lead to high corrosion rates at the effective anode surface.

A fact well established in hydrodynamics is that the flow of a fluid system is governed by a balance between the driving force for fluid flow and the resistance to fluid flow within the components of the system. Furthermore, depending upon the configuration, the velocity within local regions flow may be in the same direction but may sometimes be in the direction opposite to the fluid drive. This principle is amongst others cited in U.S. Pat. Nos. 3,755,099, 4,151,061 and 4,308,116. Inclined electrode surfaces are used to enhance/facilitate the drainage of gas bubbles from the anode and molten metal from the cathode. Hence, the design of electrolysis cells with vertical or near horizontal electrodes of both multi-monopolar and bipolar electrode arrangement, where fixed interpolar distance and the gas-lift effect are used to create a forced convection of the electrolyte flow, is not new. WO 02/31225 and U.S. Pat. Nos. 3,666,654, 3,779,699, 4,151,061 and 4,308,116, amongst others utilise such design principles, and the two latter patents also give descriptions of the use of "funnels" for up-comer(s) and down-comer(s) with respect to the electrolyte flow. U.S. Pat. No. 4,308,116 also suggests the use of a separation wall for enhanced separation of produced metal and gas. However, the inclined rod-shaped anodes described in WO 02/31225 do not set up Such a strong and controlled bubble driven flow as the present invention, and experiments show that gas will escape from all sides of such an anodes even if the bottom surface is inclined several degrees.

SUMMARY OF THE INVENTION

It is an object of the present invention to provide a method and an electrowinning cell for production of aluminium by the electrowinning of aluminous ore, preferably aluminium oxide, in a molten fluoride electrolyte, preferably based on cryolite, at temperatures in the range of 680-980° C. The method is designed to operate at equal or lower cost compared to the present production technology for electrowinning of aluminium, and thus provides a commercial and economically viable process for the production. This means the design of an electrolysis cell with the necessary cell components and outline to reduce energy consumption, reduce overall production costs and still maintain high current efficiency. The compact cell design is obtained by the use of dimensionally stable anodes and aluminium wettable or non-wettable cathodes. The internal electrolyte flux is designed to attain a high dissolution rate of alumina, even at low electrolyte temperatures, and a good separation of the two products from the electrolysis process. Problems identified with the mentioned patents (U.S. Pat. Nos. 4,681,671, 5,006,209, 5,725,744 and 5,938,914 and WO 02/31225) are also not encountered in this invention due to the more sophisticated design of the electrolysis cell.

Other Publications:

Haupin, W. and Kvande, H.: "*Thermodynamics of electrochemical reduction of alumina*", Light Metals 2000, pp. 379-384.

Shekar, R. and Evans, J. W.: "*Modeling studies of electrolyte flow and bubble behavior in advanced Hall cells*", Light Metals 1990, pp. 243-248.

Shekar, R. and Evans, J. W.: "*Physical modeling of bubble phenomena, electrolyte flow and mass transfer in simulated advanced Hall cells. Final Report*", DOE/ID-10281, University of California, Berkeley, March 1990.

Solheim. A. and Thonstad, J.: "*Model cell studies of gas induced resistance in Hall-Hèroult cells*", Light Metals 1986, pp. 397-403.

A governing principle in the present invention related to an electrolysis cell for the accomplishment of aluminium electrolysis, and for the construction principle of the aluminium electrowinning cell, is that the two products, aluminium and oxygen, shall be efficiently collected with minimal losses due to the recombination of these products. This is sought realised through a cell design where an efficient and fast drainage of the produced gas from the inter polar room in such a manner that the oxygen retention time, and therefor the back reaction between the products, are reduced to a minimum.

Oxygen bubbles are small compared to $CO_2$ which give significantly higher bubble layer resistance under oxygen generating horizontally oriented anodes compared to similar $CO_2$— generating anodes. This behaviour reduce the horizontal surface area the inert anode can have to achieve uniform current distribution and low bubble layer resistance. The present invention takes care of the said limitation by reducing the length the produced gas has to travel at the active anode surface combined with an efficient gas drainage.

The present design concept can be used to built a completely new potline, but more importantly, the anode assembly can replace carbon anodes in most of the existing Hall-Heroult Prebake and Søderberg cells producing oxygen instead of $CO_2$ at the anode. The implementation and use of such retrofitted cells has a huge economical potential because the existing potroom, cathode potlining, busbar systems, anode beam and infrastructure can be used with a minimum of adjustments/changes. One way to retrofit a prebake cell by replacing carbon anodes under operation has been described in WO Pat. Nos. 01/63012 A2, but the anodes described here are very different from the present invention.

These and other advantages can be achieved by the invention as described below.

BRIEF DESCRIPTION OF THE DRAWINGS

In the following, the invention shall be further described by figures and an example where.

DETAILED DESCRIPTION OF THE PRESENT INVENTION

Figure 1:
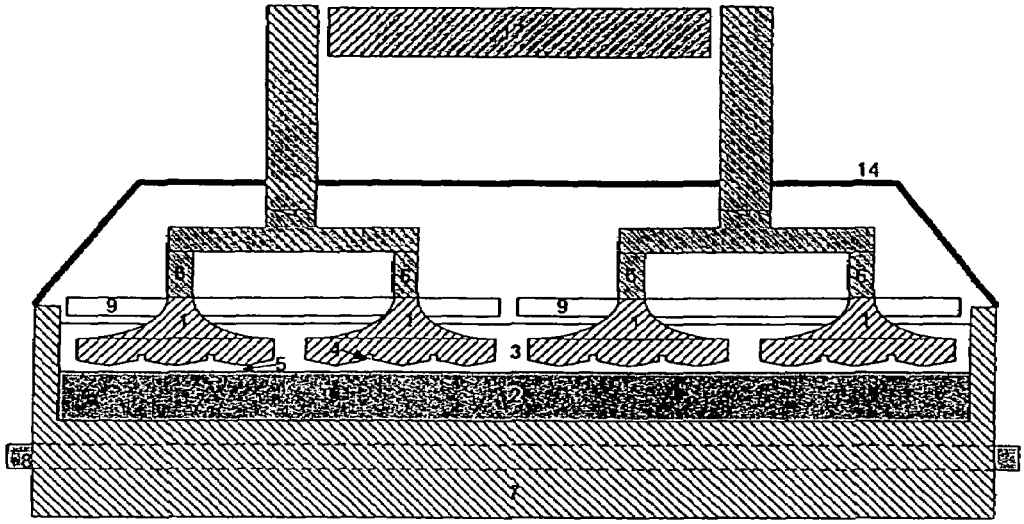
FIG. 1: Shows a schematic view of the horizontal cross section transverse of an electrolysis cell according to the invention.
Figure 2:
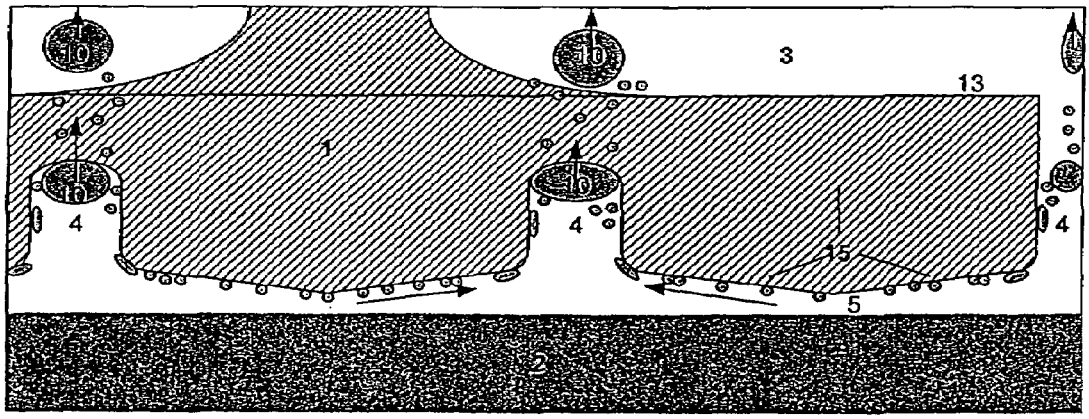
FIG. 2: Shows a horizontal cross section of the anode shown in FIG. 1.
Figure 3:
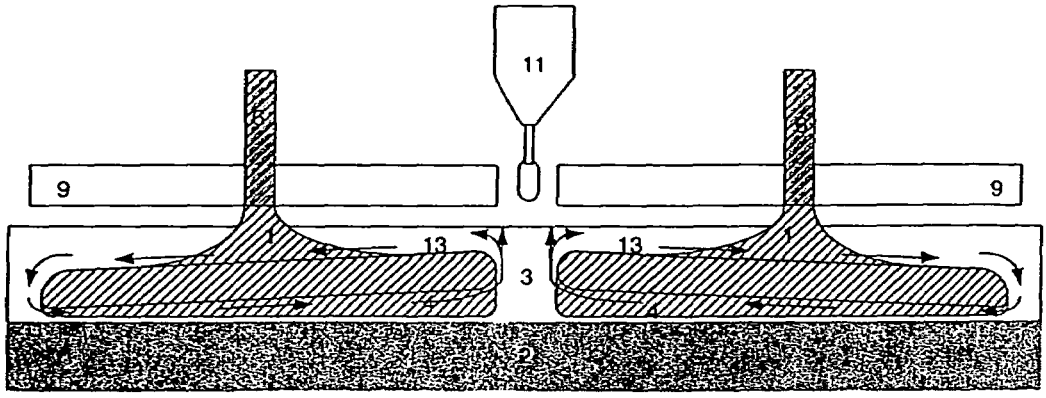
FIG. 3: Shows a horizontal section of two anodes and the circulation pattern obtained by the shape of the grooves and the exterior surface of the invented anodes which are turned 90° compared to the ones in FIG. 1.

FIGS. 1-3 disclose a cell for the electrowinning of aluminium comprising inert anodes (1) immersed in electrolyte (3) and an aluminium pool serving as a cathode (2). In operation, the produced oxygen gas (10) at the inert anode (1). The oxygen gas is produced at the inert anode electroactive surface (15), hereafter named the anode "tooth". The oxygene bubbles produced at the surface will follow the shape of the sideways sloped bottom of the anode (FIG. 2) into a groove (4). The grooves (4) have to be sloped 1-5° according to the horizontal metal surface to efficiently and quickly transport the produced oxygen away from the inter polar room (5) with a minimum of agitation and mixing of produced oxygen (10) and aluminium (2).

The end of the sloped grooves (4) should be rounded upwards at the ends (FIG. 3) to give smooth gas release and not a frequently pumping gas release. Grooved anodes have been proposed previously, but not said angled grooves in horizontally oriented anodes (FIG. 3) where shaped anode "teeth" (15) according to the present invention are as much as 10-20 cm wide.

Figure 4:
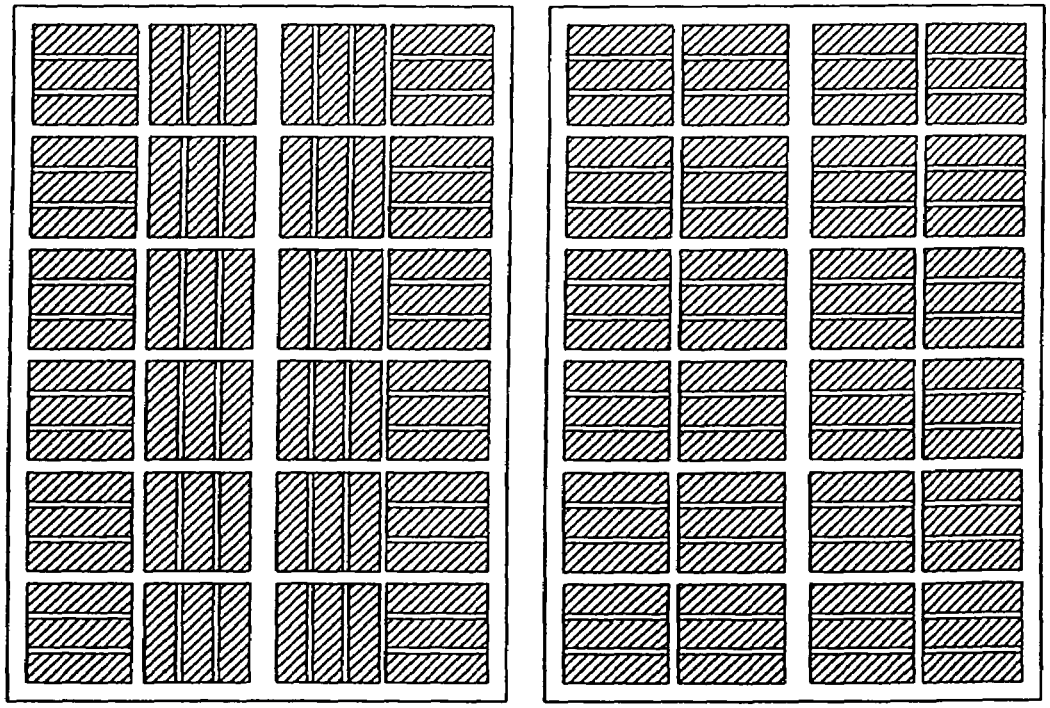
FIG. 4: Shows two examples of the bottom surface of anode clusters in two cells facing s molten aluminium cathode with different orientation of the grooves.

The centre line at the bottom of the anode "tooth" (1) shown in FIGS. 3 and 4. are parallel to the cathode surface, but there should be sloped sideways at the tooth angled 1-5° perpendicular to the centre line towards the grooves (4). The surface of the anode teeth should be horizontally oriented or angled 1-2°. The number of grooves (4) in each anode (1) are balanced with the number of teeth (15) in each anode, which again is a function of size and current density. The current density on the active anode surface facing the cathode can vary between 0.3-1.5 $A/cm^2$. Two or more anodes form an anode "cluster" (FIG. 1) which are connected to anode raisers (6) and via the anode beam to the busbar system, in a similar way as for a prebake anode obvious to a person skilled in the art of aluminium production. This makes it easy and economically favourable to retrofit existing prebake and Søderberg cells to use present invented anodes. In addition, these new anodes are easy to adjust and replace whenever necessary.

The shape of the anode teeth (15) and grooves have been modelled and optimised in a reference system, in which the physical parameters like viscosity, bubble size, etc. are optimised to fit the cryolite-oxygen system an an Hall-Heroult cell with inert anodes. The model shows that gas is released by drainage from all the sides of the anode, protecting the anode from reacting with dissolved aluminium, but most of the gas is released from the end of the grooves which also set up the main stream in the inter polar room and between the anodes.

Figure 5:
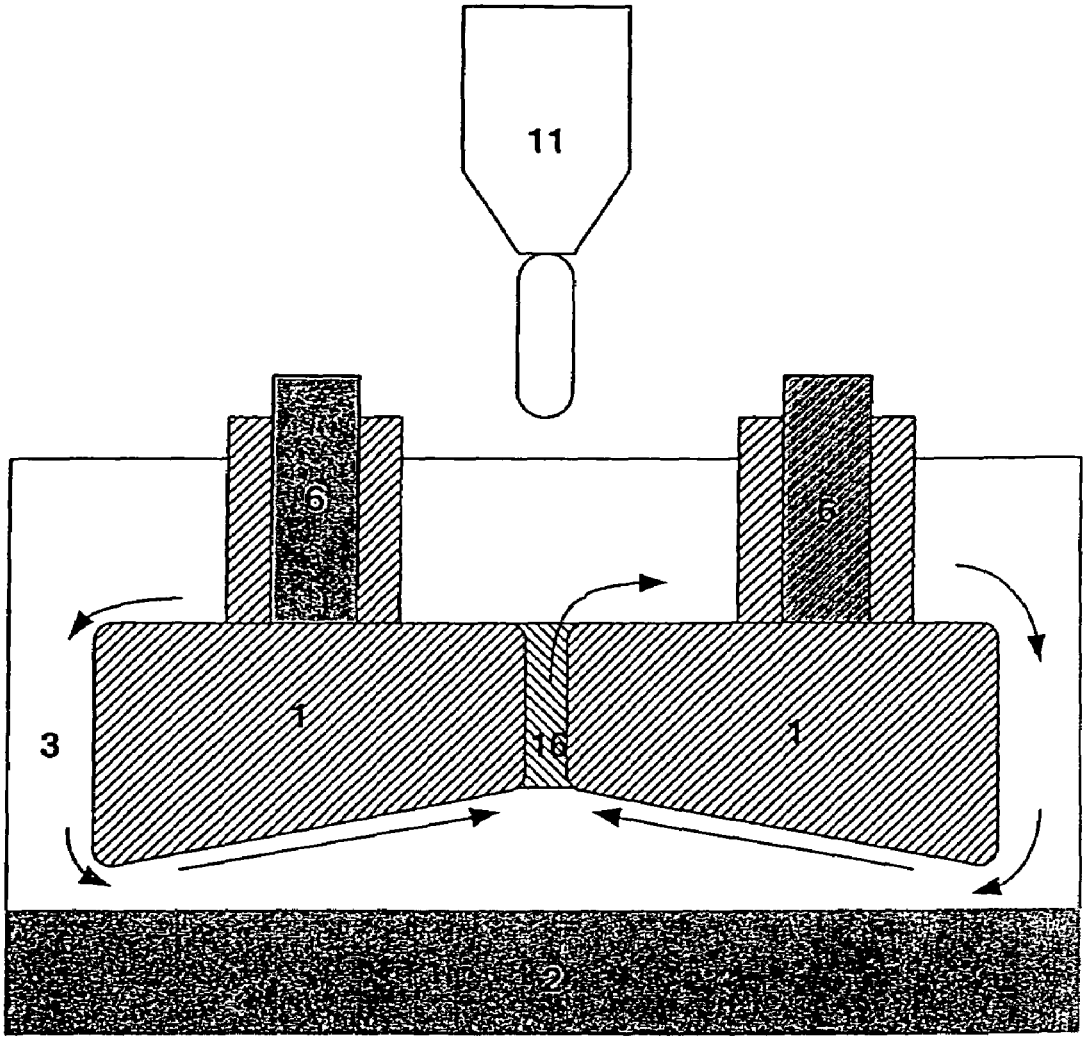
FIG. 5: Shows an alternative anode shape where the bottom of the anode facing the cathode can be shaped like a cone or a roof with 3 or more planes with angled or straight surfaces towards a hole in the top where produced anode gas can escape.

The anode can also be shaped in such a way that the bottom of the anode facing the cathode can be shaped like a cone or a roof with 3 or more planes with angled or straight surfaces facing upwards towards a hole (16) where produced anode gas easily and efficiently can be transported away from the active anode surface and escape, and at the same time set up a circulation pattern around the anode (see FIG. 5). The electrolyte in the anode hole (16) will be turbulent and well suited for alumina addition (11). The gas-induced bath circulation will make sure that added alumina efficiently is distributed around the anode keeping the alumina concentration around the anode constant at a predetermined level. Further, the anode is shaped to set up a circulation pattern that distributes fresh electrolyte to all parts of the cell.

The anode to cathode distance can be kept at a minimum because of the small oxygen bubbles (10) produced at the anodes (1) efficiently are removed from the inter polar room via the grooves and the sides of the anodes. To keep the produced heat within the cell, there can be insulation on top (9) of the anode and in the bottom of the cathode pot lining (7). The anode top is covered by a lid (14).The top of the anode should be insulated to run the cell thermally in balance with a reduced inter polar distance compared to traditional Hall-Hèroult cells The buoyancy-generated bubble forces (gas-lift effect) on one side and the flow resistance on the other hand to give a net motion of the electrolyte (FIG. 3) to provide the required alumina dissolution and supply, as well as separation of the products. This is accomplished by forming the exterior of the anode (13) in a way that is optimised with respect to flow behaviour (see FIG. 3), and the direction of the flow is set up by sloping the bottom of the grooves in the desired direction (ex. FIG. 4). The direction of the sloped grooves can be changed from one anode to the other, and even on the same anode, to set up desired flow patterns and loops in the cell (FIG. 4). The anodes should preferably be totally immersed to give a strong and controlled electrolyte circulation.

The cell is located in a steel container, or in a container made of another suitable material. The container has a thermal insulating lining (7) and a refractory lining with excellent resistance to chemical corrosion by both fluoride-based electrolyte and produced aluminium (2). Alumina is preferably fed more or less continuously, or in very small batches (semi-continuously), through one or more feeding points (11) and into the highly turbulent flow region of the electrolyte between the electrodes of the cell (FIG. 2). This will allow a fast and reliable dissolution of alumina, even at low bath temperatures and/or high cryolite ratios of the electrolyte without muck formation at the bottom of the cell. These anodes are connected to a peripheral busbar system via connectors (6), in which the temperatures can be controlled through a cooling system, if necessary. In particular, the anode and/or the anode connections can be cooled by water cooling or other liquid coolants, by gas cooling, or by use of heat pipes.

The off-gases and evaporated electrolyte formed in the cell during the electrolysis process will be collected in the top part (14) of the cell above the anodes. The off-gases can then be extracted from the cell through an exhaust system. The exhaust system can be coupled to the alumina feeding system (11) of the cell, and the hot off-gasses can be utilised for preheating of the alumina feed stock. Optionally, the finely dispersed alumina particles in the feed stock may act as a gas cleaning system, in which the off-gasses are completely and/or partially stripped from any electrolyte droplets, particles, dust and/or fluoride pollutants in the off-gasses from the cell. The cleaned exhaust gas from the cell is then connected to the gas collector system of the potline. The particulates of alumina which are fed to the cell should be as fine as possible.

The present cell design achieves controlled drainage of produced gas and a well defined flow pattern in the electrolysis cell, which are of crucial importance to obtain a rapid alumina dissolution and distribution at a constant and high concentration. By keeping the width of the anode teeth/bars low (FIG. 4) and with only 1-5° slope towards the grooves perpendicular to the anode teeth one obtains a uniform current distribution on the anode teeth and low bubble layer induced voltage drop. To avoid localised area of high current densities at the anodes, all the corners (including the corners and edges of the anode and the grooves) are smoothened/rounded to give a uniform flow characteristic and current density. Hence, the unfortunate consequence of previously patented design solutions is avoided, where clusters of anode "flower pots", "bolts" or "rods" are positioned horizontally or with tilted bottom will give turbulence around the anode "rods" and less tendency for distribution of alumina to the periphery of the cell, which requires a higher number of alumina feeders in the cell to obtain a uniformly high alumina concentration. The chance of alumina build ups at the bottom of the cell (muck formation) is also considered to be less likely with the present invention.

A reduction in the exposed cathodic surface area will reduce the contamination levels of anode material in the produced metal, thus reducing the anodic corrosion during the electrolysis process, which is difficult to obtain in a retrofit cell unless a complete new cell is designed. However, a reduction in the anodic corrosion can be obtained by reducing the anodic current density (for example by increasing anodic surface area) and by lowering the operating and/or anode temperature.

The shown multi-monopolar anode clusters (1) may obviously be manufactured as several smaller units and assembled to form an anode of the desired dimensions. In addition all the inert anode clusters (1) can be exchanged whenever necessary.

Continuous operation of the said electrolysis cell requires the use of dimensionally stable inert anodes (1). The anodes are preferably made of metals, ceramic materials, metal ceramic composites (cermets) or combinations thereof, with high electrical conductivity. The cathodes (2) can be non-wetted carbon-based or wettable by aluminium in order to operate the cell at constant interpolar distances (5) Wettable cathodes are preferentially made from a mixture of carbon and titanium diboride, zirconium diboride or mixtures thereof, or by adhering layer(s) of aluminiumwettable materials to traditional carbon blocks. Likewise, the cathode can also be made of carbon-based cathode blocks, or from carbon composites of other electrically conducting refractory hard metals (RHM) based on borides, carbides, nitrides or suicides, or combinations and/or composites thereof. The electrical connections to the anodes are preferentially inserted through the lid (14) as shown in FIG. 1. The connections (8) to the cathodes (collector bars) are inserted through the cathode potlining (7) well known to a person skilled in the art.

The invented cell can be operated at a low interpolar distance (5) to save energy during aluminium electrowinning. Low interpolar distances implies that the heat generated in the electrolyte can be reduced compared to traditional Hall-Hèroult cells. The magnetic field of the cell and the busbar system have to be optimised to make operation with a very low inter electrode distance feasible without the risk of short circuiting the electrodes, which will destroy the anode material and reduce current efficiency. The energy balance of the cell can hence be regulated by designing a correct thermal insulation (7) in the sides and the bottom is necessary, as well as in the cell top (9, 14). The cell can then be operated with a self-regulating frozen ledge covering the side walls well known to a person skilled in the art. The anode should preferably be totally immersed in the electrolyte to achieve sufficient electrolyte flow and thermal balance in the cell.

Excess heat generated must be withdrawn from the cell through the sides of the cell. The cell liner (7) is preferably made of densely sintered refractory materials with excellent corrosion resistance toward the used electrolyte and aluminium. Suggested materials in addition to carbon based cathode blocks are silicon carbide, silicon nitride, aluminium nitride, and combinations thereof or composites thereof. Additionally, at least parts of the cell lining can be protected from oxidising or reducing conditions by utilising protective layers of materials that differs from the bulk of the dense cell liner described above. Such protective layers can be made of oxide materials, for instance aluminium oxide or materials consisting of a compound of one or several of the oxide components of the anode material and additionally one or more oxide components.

The invented cell is designed for operation at temperatures ranging from 880° C. to 970° C., and preferably in the range 900-940° C. The low electrolyte temperatures are attainable by use of an electrolyte based on sodium fluoride and aluminium fluoride, possibly in combination with alkaline and alkaline earth halides. The composition of the electrolyte is chosen to yield (relatively) high alumina solubility, low liquidus temperature and a suitable density to enhance the separation of gas, metal and electrolyte.

To reduce the dissolution of the anode material, it is beneficial to keep the temperature at the anode surface (interface) as low as possible without the risk of freeze out since the saturation limits of the anode materials are reduced with falling temperature. By designing the anode assemble in such a way that there is a net flux of heat from the bath into the active surface of the anode, a few degrees lower anode surface can be obtained. The anode and/or the anode connections can be cooled to provide heat exchange heat recovery and/or temperature control of the anode and/or the cathode, The anode and/or the anode connections can be cooled by water cooling or other liquid coolants by gas cooling, or by use of heat pipes. In addition, one can introduce an internal cooling circuit in the anode using for example a heat-pipe. U.S. Pat. No. 4,737,247 shows an example of how a heat-pipe can be used for other applications than cooling the anode.

The accumulation of gas underneath the anode causes an extra voltage drop. The gas volume as well as the resistance are strongly dependent on the size of the gas bubbles and the size of the active anode, i.e. the distance the produced anode gas bubbles have to travel to escape from the edges of the lower anode surface. Oxygen bubbles produced on inert anodes in cryolite are extremely small (1-2 mm) compared to $CO_2$ on carbon anodes. The effect is more accumulated oxygen gas volume under the inert anodes compared to $CO_2$, and it limits the optimum size of the inert anode. The active anode surface therefore has to be shaped to efficiently drain away the produced gas from this surface. In the present invention the surface of the active anode parts (called "teeth") is V-shaped leading the gas to the grooves, and the width of the teeth must be minimized according to acceptable bubble layer resistance and current distribution induced by accumulation of gas on these anode teeth. This aspect of inert anode technology is discussed by Solheim and Thonstad, without the authors stating the optimum dimensions.

It should be understood that the suggested aluminium electrowinning cell as presented in the example relating to FIGS. 1-5, represents only one particular embodiment of the cell, which may be used to perform the method of electrolysis according to the invention.

The invention claimed is:

1. A method for electrolytic production of aluminum metal from an electrolyte including aluminum oxide, the method comprising:

performing electrolysis in an electrowinning cell comprising at least one inert anode and at least one cathode, the at least one anode and the at least one cathode being arranged so as to face each other, wherein the at least one anode evolves oxygen gas and aluminum is discharged onto the at least one cathode during the electrolysis, the at least one cathode being substantially horizontal; and directing the oxygen gas to flow into grooves in an electroactive surface of the at least one anode so as to be drained away from an interpolar room, and so as to establish and enforce an electrolyte flow pattern between the at least one cathode and the at least one anode and over the at least one anode, wherein the grooves of the at least one anode define a plurality of anode teeth, each of the anode teeth having a V-shaped bottom surface which slopes from a center line of a respective anode tooth toward an adjacent groove, and wherein the grooves are sloped in a longitudinal direction of the grooves and away from the at least one cathode.

2. A method in accordance with claim 1, wherein at least one of the at least one anode and an anode connection is configured to be cooled so as to provide at least one of (1) heat exchange with at least one of the at least one anode and the at least one cathode, (2) heat recovery from at least one of the at least one anode and the at least one cathode, and (3) temperature control.

3. A method in accordance with claim 1, wherein at least one of the at least one anode and an anode connection is configured to be cooled by means of liquid cooling, gas cooling, or by the use of heat pipes.

4. A method in accordance with claim 1, wherein feeding of alumina to the cell is continuous or semi-continuous, and wherein the alumina fed to the cell contains as fine particulates as possible.

5. A method in accordance with claim 1, wherein the cell uses an electrolyte with a temperature in the range of 880-970° C.

6. An electrowinning cell for electrolytic production of aluminum metal from an electrolyte including aluminum oxide, the cell comprising:

at least one inert anode and at least one cathode, the at least one anode and the at least one anode being arranged so as to face each other, the at least one cathode being substantially horizontal, wherein the anode is configured to evolve oxygen gas during an electrolysis process in which aluminum is discharged onto the at least one cathode such that the oxygen gas enforces an electrolyte flow pattern, wherein the electrolyte flow pattern is to be established between the at least one cathode and the at least one anode and over the at least one anode; and grooves arranged in an electroactive surface of the at least one anode so as to drain away oxygen from an interpolar room, wherein the grooves of the at least one anode define a plurality of anode teeth, each of the anode teeth having a V-shaped bottom surface which slopes from a center line of a respective anode tooth toward an adjacent groove, and wherein the grooves are sloped in a longitudinal direction of the grooves and away from the at least one cathode.

7. An electrowinning cell in accordance with claim 6, wherein the grooves have a depth of 1-3 cm and a width of 1-3 cm.

8. An electrowinning cell in accordance with claim 7, wherein the bottom surface of each of the anode teeth is sloped 1-5° from the center line of the respective anode tooth towards an adjacent groove so as to efficiently drain produced gas into the adjacent groove.

9. An electrowinning cell in accordance with claim 7, wherein the bottom surface of each of the anode teeth is sloped 1-2° from the center line of the respective anode tooth towards an adjacent groove, and wherein the grooves are sloped in the longitudinal direction of the grooves and away from the at least one cathode at an angle of 1-5° so as to obtain efficient drainage of produced gas collected in the grooves and establish a desired flow pattern in the electrolyte.

10. An electrowinning cell in accordance with claim 7, wherein each of the anode teeth has a width of 10-20 cm so as to obtain a uniform current density and a low bubble layer resistance.

11. An electrowinning cell in accordance with claim 6, wherein corners and edges of the grooves and at least one anode are at least one of smoothened and rounded so as to provide a uniform flow characteristic and current density.

12. An electrowinning cell in accordance with claim 6, wherein a top surface of the at least one anode is shaped to set up a circulation pattern for distributing fresh electrolyte to all parts of the cell.

13. An electrowinning cell in accordance with claim 6, wherein a top of the at least one anode is insulated above a bath level around stubs as well as a cathode bottom to make it possible to run the cell thermally in balance with a reduced inter polar distance as compared to traditional Hall-Heroult cells.

14. An electrowinning cell in accordance with claim 6, wherein the at least one anode is totally immersed in the electrolyte so as to achieve sufficient electrolyte flow and thermal balance in the cell.

15. An electrowinning cell in accordance with claim 6, wherein the at least one anode comprises a plurality of anodes, and wherein two or more anodes form an anode cluster, the anode cluster being connected to an anode raiser, and being connected to a busbar system via an anode beam.

16. An electrowinning cell in accordance with claim 15, wherein the plurality of anodes comprises a plurality of anode clusters, and wherein the anode clusters are arranged so as to orient the grooves in such a way that produced oxygen in the grooves sets up an electrolytic flow pattern that facilitates sufficient electrolytic flow velocity to obtain uniform distribution of alumina in the cell without muck formation.

17. An electrowinning cell in accordance with claim 16, wherein the anode clusters are arranged at an optimized position with respect to an orientation of the grooves and an orientation of side and center channels so as to provide a desired alumina mixing and distribution.

18. An electrowinning cell in accordance with claim 15, wherein the plurality of anodes comprises a plurality of anode clusters, and wherein the anode clusters are arranged at an optimized position with respect to an orientation of the grooves and an orientation of side and center channels so as to provide a desired alumina mixing and distribution.

19. An electrowinning cell in accordance with claim 6, wherein the bottom surface of each of the at least one anode is cone-shaped or roof-shaped with three or more planes which include surfaces angled towards a hole in a top surface of the grooves where produced gas can escape.

20. An electrowinning cell in accordance with claim 6, wherein the at least one anode has a ceramic outer surface, and wherein a center portion of the at least one anode is made of an electrical conducting material including a cermet or a metal or a combination thereof.

21. An electrowinning cell in accordance with claim 6, wherein the at least one anode is comprised of a plurality of smaller units integrated in one larger unit.

22. An electrowinning cell in accordance with claim 6, wherein the cell is connected to at least one gas exhaust system for extracting and collecting gasses from an electrolysis chamber.

23. An electrowinning cell in accordance with claim 6, further comprising an exhaust system which is connected to an alumina feeding system in which hot off-gasses are used for at least one of heating alumina feed stock and cleaning of the off-gasses from the cell to remove at least one of fluoride vapors, fluoride particulates and dust before entering a gas collection system.

24. An electrowinning cell in accordance with claim 6, wherein the at least one cathode is manufactured from carbon blocks or carbon covered or mixed with an electrically conductive refractory hard material (RHM) based on borides, carbides, nitrides, silicides or mixtures thereof.

25. An electrowinning cell in accordance with claim 6, wherein the at least one cathode is made of horizontal carbon blocks or drained carbon composite blocks.

26. An electrowinning cell in accordance with claim 6, wherein the at least one cathode comprises an aluminum pool, the aluminum pool being stabilized by an optimized busbar system magnetic field.

27. An electrowinning cell in accordance with claim 6, wherein the cell has a sidewall lining made of an electrically non-conductive material.

28. An electrowinning cell in accordance with claim 6, wherein a sidewall lining of the cell is made of a material selected from aluminum oxide, aluminum nitride, silicon carbide, silicon nitride, and combinations thereof or composites thereof.

29. An electrowinning cell in accordance with claim 6, wherein the at least one anode comprises a plurality of anodes, and wherein the cell further comprises at least one feeding point for alumina located at a position close to high-turbulence areas in the electrolyte, and in an area between two or more of the anodes.

* * * * *